US010384820B2

(12) United States Patent
Grimm et al.

(10) Patent No.: US 10,384,820 B2
(45) Date of Patent: Aug. 20, 2019

(54) THERMOFORM PACKAGING MACHINE AND METHOD

(71) Applicant: MULTIVAC SEPP HAGGENMÜLLER GMBH & CO. KG, Wolfertschwenden (DE)

(72) Inventors: Bernhard Grimm, Kempten (DE); Elmar Ehrmann, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 912 days.

(21) Appl. No.: 14/746,613

(22) Filed: Jun. 22, 2015

(65) Prior Publication Data

US 2015/0367971 A1 Dec. 24, 2015

(30) Foreign Application Priority Data

Jun. 24, 2014 (EP) ..... 14173592

(51) Int. Cl.

| | |
|---|---|
| ***B65B 31/02*** | (2006.01) |
| ***B65B 9/04*** | (2006.01) |
| ***B65B 47/02*** | (2006.01) |
| ***B65B 47/10*** | (2006.01) |

(52) U.S. Cl.

CPC ..... *B65B 31/021* (2013.01); *B65B 9/04* (2013.01); *B65B 9/045* (2013.01); *B65B 47/02* (2013.01); *B65B 47/10* (2013.01)

(58) Field of Classification Search

CPC ..... B65B 31/021; B65B 47/10; B65B 47/02; B65B 9/045; B65B 9/04

See application file for complete search history.

(56) References Cited

U.S. PATENT DOCUMENTS

| | | | | |
|---|---|---|---|---|
| 3,491,504 | A * | 1/1970 | Pasco | B65B 31/021 53/427 |
| 3,956,867 | A * | 5/1976 | Utz | B65B 9/04 53/433 |
| 4,796,408 | A * | 1/1989 | Mobark | B65B 31/021 426/396 |
| 4,994,638 | A * | 2/1991 | Iorns | B29C 49/0047 206/564 |
| 6,282,866 | B1 * | 9/2001 | Natterer | B65B 7/164 198/833 |
| 9,988,194 | B2 * | 6/2018 | Brandl | B65B 61/06 |
| 2002/0063070 | A1 * | 5/2002 | Stockley, III | B65B 31/025 206/213.1 |

(Continued)

FOREIGN PATENT DOCUMENTS

| | | | | |
|---|---|---|---|---|
| DE | 2337730 | A1 * | 2/1975 | B65B 9/04 |
| DE | 10237933 | A1 | 2/2004 | |

(Continued)

*Primary Examiner* — Alexander M Valvis
*Assistant Examiner* — Mobeen Ahmed
(74) *Attorney, Agent, or Firm* — Husch Blackwell LLP

(57) ABSTRACT

The present invention relates to a thermoform packaging machine as well as to a method for producing a skin pack, comprising the steps of preforming a skin film prior to a sealing station and subjecting it to a further forming step in the sealing station, so that the skin film can wrap around a product protruding far beyond a packaging trough.

6 Claims, 7 Drawing Sheets

(56) References Cited

U.S. PATENT DOCUMENTS

| | | | | |
|---|---|---|---|---|
| 2004/0016208 | A1* | 1/2004 | Mumpower | B32B 7/02 53/411 |
| 2005/0173289 | A1* | 8/2005 | Natterer | B65B 9/04 206/524.8 |
| 2009/0173039 | A1* | 7/2009 | Slomski | B65B 9/045 53/167 |
| 2010/0101612 | A1* | 4/2010 | Wiedemann | B65D 65/46 134/25.2 |
| 2010/0137087 | A1* | 6/2010 | Ruzic | B65B 41/14 474/202 |
| 2010/0287893 | A1* | 11/2010 | Ehrmann | B65B 7/01 53/487 |
| 2012/0248005 | A1* | 10/2012 | Bergey | B65D 75/327 206/539 |
| 2014/0216975 | A1* | 8/2014 | Chrysanthidis | B65D 81/3272 206/524.6 |
| 2015/0056342 | A1* | 2/2015 | Owensby | B65D 75/32 426/129 |
| 2015/0126349 | A1* | 5/2015 | Ishihara | B65D 75/008 493/194 |
| 2015/0203223 | A1* | 7/2015 | Ehrmann | B65B 31/02 493/52 |
| 2017/0021955 | A1* | 1/2017 | Ehrmann | B65B 47/02 |
| 2017/0029146 | A1* | 2/2017 | Palumbo | B65B 11/52 |

FOREIGN PATENT DOCUMENTS

| | | | |
|---|---|---|---|
| EP | 0186729 | A1 | 7/1986 |
| EP | 0270208 | A1 | 6/1988 |
| EP | 2412643 | A1 | 2/2012 |
| GB | 1242726 | | 8/1971 |
| WO | 0038992 | A1 | 7/2000 |
| WO | 2004000650 | A1 | 12/2003 |

* cited by examiner

THERMOFORM PACKAGING MACHINE AND METHOD

CROSS-REFERENCE TO RELATED APPLICATIONS

This Application claims priority to European Patent Application Number 14173592.8 filed Jun. 24, 2014, to Bernhard Grimm et al., currently pending, the entire disclosure of which is incorporated herein by reference.

FIELD OF THE INVENTION

The present invention relates to a thermoform packaging machine and method of operating a thermoform packaging machine.

BACKGROUND OF THE INVENTION

DE 102 37 933 A1 discloses a tray sealer used for producing skin packs in which the product protrudes beyond a tray edge. To this end, the skin film is clamped in position on the sealing-tool upper part and drawn into a dome prior to moving the sealing-tool lower part, together with the tray and the product, into contact with the sealing-tool upper part. The skin film does not come into contact with the product until the skinning process takes place.

EP 2 412 643 A1 shows a thermoform packaging machine with a top-film forming station for sealing a product that protrudes vertically beyond a tray edge with a shrink film and a trough, without the product itself deforming the shrink film by an upward movement prior to the sealing process. The top-film forming station, which is located upstream of the sealing station, ensures that the shrink film is pre-deformed. A clamp chain is arranged on both sides for laterally holding and guiding the deformed shrink film while it is being conveyed from the top-film forming station to the sealing station, and for positioning it precisely onto the trough.

WO 2004/000650 A1 discloses a thermoform packaging machine for producing a shrink pack, where both the bottom film and the top film are shrink films. The thermoform packaging machine comprises a bottom-film and a top-film forming station, in which each film is thermoformed individually prior to the sealing process, so that a product to be packed can be packed in the sealing station. The shrinking effect of the films, through which the films are caused to wrap tightly around the product, is produced in a shrinking apparatus, which is located downstream of the thermoform packaging machine, through introduction of heat, for example, in a hot water bath. A difference between shrink packs and skin packs is to be seen in that in the case of shrink packs the heat for the shrinking process is supplied only after the packaging process, whereas in the case of skin packs the heat is introduced into the skin film already in the sealing station prior to the sealing process. A similar shrink film packaging machine is disclosed in EP 2 412 643 A1.

EP 0 270 208 A1 discloses a thermoform packaging machine for producing a skin pack. A skin film used as a top film and a trough, which has been formed in a bottom film and into which a product has been placed, are conveyed together into a first forming station and are clamped on all sides thereof between a forming-tool lower part and a forming-tool upper part for drawing the skin film then upwards into a dome by means of a vacuum and for heating it there. This process results in a minor deformation so that, when the forming-tool lower part and the forming-tool upper part have been opened, the skin film, while being conveyed together with the trough and the product into a downstream sealing station, will not apply pressure to the product as long as the product does not protrude too far upwards beyond the trough. Due to the heat input, the skin film already exhibits an elasticity which is suitable for allowing the skin film to be drawn, in the sealing station after the formation of a chamber through a sealing-tool lower part and a sealing-tool upper part, into a dome by means of a vacuum, the dome comprising a much larger (four times larger) hollow than the dome in the forming-tool upper part. Subsequently, the skin film is heated to an elevated temperature in the dome for producing then, by means of a vacuum between the skin film and the trough, a skin pack in the case of which the skin film wraps tightly around the product and the inner surfaces of the trough, thus sealing the product in an air-tight manner. A larger deformation of the skin film in the forming station is not provided.

Products protruding vertically beyond the trough edge entail the risk of wrinkle formation in the clamping area during closing of the sealing-tool lower part and the sealing-tool upper part, and this may lead to faulty sealing and leakiness later on. In order to reduce or avoid such wrinkle formation, also the lateral distance from the product to the trough edge has hitherto been increased, when there is an increase in product protrusions. The resultant packages thus have a large trough area with an upwardly protruding product. These packages are, on the one hand, not attractive and, on the other hand, they necessitate the use of a larger amount of top film and bottom film, which, in turn, results in an increase in packaging costs and simultaneously in a reduction of the packaging performance of the thermoform packaging machine, since the number of products that can be processed during one work cycle decreases. In thermoform packaging machines with a multi-lane or multi-row format, the risk of wrinkle formation increases still further.

SUMMARY OF THE INVENTION

It is an object of the present invention to provide a thermoform packaging machine, which reduces film consumption in the production of a skin pack with products exhibiting product protrusions.

The thermoform packaging machine according to one embodiment the present invention comprises a bottom-film forming station including a number n of mold cavities, n being an integer larger than or equal to 2, for forming n troughs into a bottom film, and a top-film forming station including n evacuable domes, which are each enclosed by a clamping surface and which have a first height between the clamping surface and a hollow (viz. depression), for forming n lids into a top film, which is a skin film. The top-film forming station can be arranged upstream of a sealing station in a production direction, the sealing station being configured for sealing the n lids with the n troughs associated therewith, and the sealing station including a sealing-tool upper part comprising n heatable and evacuable domes having a second height. The domes may be configured for allowing the top film to be brought into contact with the respective dome from inside and for heating it to a skin temperature. In one embodiment, the first height amounts to at least 80% of the second height.

Preforming the skin film in a top-film forming station to a first height amounting to at least 80% of the second height may ensure a pressure-free pulling of the lids over the products, so that the distance between the product placed on the trough and the trough edge can be reduced to, for example, a distance of less than 20 mm, even if products with product protrusions of more than 60 mm are packed with a skin film. By reducing the dimensions of the troughs, the amount of bottom film and top film consumed can be reduced and the efficiency of the machine can be increased, since more packages can be processed during a work cycle in the work stations. In addition, a skin pack with a small distance between the product and the trough edge is more attractive than a skin pack in which the distance is large. Furthermore, the amount of space required for such skin packs on a cooling shelf or in deep freezers can be reduced.

According to one embodiment, the second height is at least 60 mm, and according to another embodiment at least 80 mm, so that particularly large products and products protruding upwards beyond the trough edge can be packed.

The skin temperature may be at least 170° C. so as to accomplish air-tight, large-area sealing between the skin film and the trough.

According to one embodiment, a top-film conveying unit is provided, which is arranged on both sides of the top film, for conveying the lids from the top-film forming station into the sealing station. The lid can thus be transferred synchronously to the trough and the product up to and into the sealing station, and, due to the fact that the skin film is held on both sides until it is clamped in position in the sealing station, transverse stresses in the skin film itself will not result in a formation of wrinkles that may lead to insufficient air tightness.

The mold cavities have a cavity depth and, in one instance, the second height of the domes in the sealing-tool upper part is at least 5 times, and in another instance, at least 8 times as large as the cavity depth. This allows for the production of an attractive, reduced-volume skin pack with a high product on a kind of plate defined by the trough.

According to one embodiment, the n mold cavities in the bottom-film forming station each have an opening length in the longitudinal direction of the production direction and an opening width in a direction transverse to the production direction, and the n domes in the top-film forming tool upper part each have a first opening length in the longitudinal direction of the production direction and a first opening width in a direction transverse to the production direction, the first opening length and the first opening width of the domes amounting each to a value between about 80% and about 95% of the opening length and opening width, respectively, of the mold cavity, so that the molded lids will have dimensions that are larger than those of a product to be packed, when they are supplied to the sealing station. The preforming of the lids allows the skin film, due to the small distance at which it is spaced from the inner wall of the domes in the sealing-tool upper part, to be applied rapidly by means of a vacuum and heated, so that the skinning process can be executed subsequently. This reduces the cycle time of the sealing station and increases thus the total packaging output further.

A method according to one embodiment of the present invention used for operating a thermoform packaging machine for producing a skin pack including a product that protrudes upwards, at least over 50 mm, vertically beyond a trough edge of a trough of a bottom film, the top film being a skin film, comprises the following steps:

jointly forming a number of n troughs, n being larger than or equal to 2, into a bottom film in a bottom-film forming station during a work cycle, jointly forming n lids into a top film in a top-film forming station at a first temperature during a work cycle, the lids having then a first height relative to a top-film conveying plane, jointly supplying the n troughs and the n lids into a sealing station, bringing the n lids into contact with the inner wall of the domes of the sealing station by means of a vacuum between the n lids and n domes and heating the n lids to a second temperature, applying the n lids to the respective products and the troughs associated therewith by means of a vacuum generated between the n lids and the n troughs.

The lids can be formed in the top-film forming station such that the lids, while being conveyed from the top-film forming station into the sealing station, approach the associated troughs without applying any pressure to the products of the associated troughs.

According to one embodiment, the top film is conveyed by means of a top-film conveying unit, for example, by means of two clamp chains arranged on both sides of the top film.

The first temperature to which the skin film is heated may be a temperature between about 100° C. and about 140° C. so as to cause only a permanent deformation of the skin film such that lids are formed.

The second temperature to which the skin film is heated may be a temperature between about 170° C. and about 220° C. so as to produce the elasticity of the skin film for the subsequent skinning process.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the present invention will be explained in more detail making reference to a drawing. The individual figures show.

Like components are provided with like reference numerals throughout the figures.

DETAILED DESCRIPTION OF THE INVENTION

Figure 1:
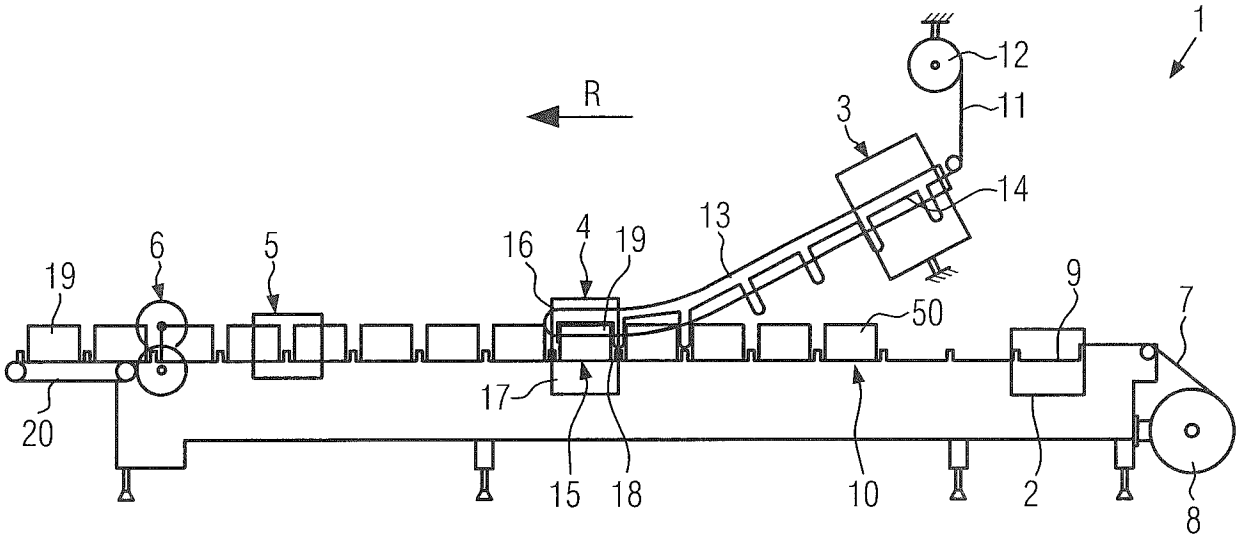
FIG. 1 is a schematic side view of a thermoform packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a thermoform packaging machine 1 according to one embodiment of the present invention in a schematic side view, with a production direction R. In the production direction R, a plurality of work stations, such as a bottom-film forming station 2, a top-film forming station 3, a sealing station 4, a cross cutting station 5 and a longitudinal cutting station 6, can be provided in succession. In the following, the mode of operation of the thermoform packaging machine 1 according to one embodiment of the present invention will be explained in more detail.

A bottom film/foil 7, configured, for example, as a hard film made of plastic, can be unwound from a first film roll 8 and grasped on both sides thereof by a clamp chain, which is not shown in detail, and conveyed into the bottom-film forming station 2. In the bottom-film forming station 2, the bottom film 7 may be heated and two troughs 9, which, relative to the drawing plane, are shown as arranged one behind the other and thus in two lanes (i.e., side by side when seen in the production direction R), are formed into the bottom film 7. Along an infeed line 10, which is arranged between the bottom-film forming station 2 and the sealing station 4, products 50 are placed into the troughs 9, the products 50 having a height of more than 50 mm.

A top film 11, configured as a skin film, can be unwound from a second film roll 12 and conveyed by means of a top-film conveying unit 13, which may be arranged on both sides, into the top-film forming station 3, where it can be heated to a first temperature of approximately 120° C., for example, so as to form therein two lids 14, which, relative to the drawing plane, are arranged one behind the other and thus in two lanes. During the conveying movement of the lids 14 by means of the top-film conveying unit 13 towards the sealing station 4, the lids 14 are moved closer to the troughs 9 and the bottom film 7 and, in the course of this movement, they may be pulled over the products 50 without any pressure being applied to the products 50, since the lids 14 are formed such that their dimensions are larger than the dimensions of the products 50.

The top-film conveying unit 13, for example, in the form of two clamp chains 13 arranged on both sides of the top film 11, may fulfill here, on the one hand, the function of precisely positioning the lids 14 above and onto the products 50 and may be moved in synchronism with the clamp chain for the bottom film 7. On the other hand, the top-film conveying unit 13 may fulfill the function of laterally holding the skin film 11 and the lids 14, respectively, during the conveying movement and in the interior of the sealing tool 4. A distortion of and wrinkle formation in the skin film 11, which may be caused by possibly occurring transverse stresses within the skin film 11, can be prevented in this way.

Figure 3A:
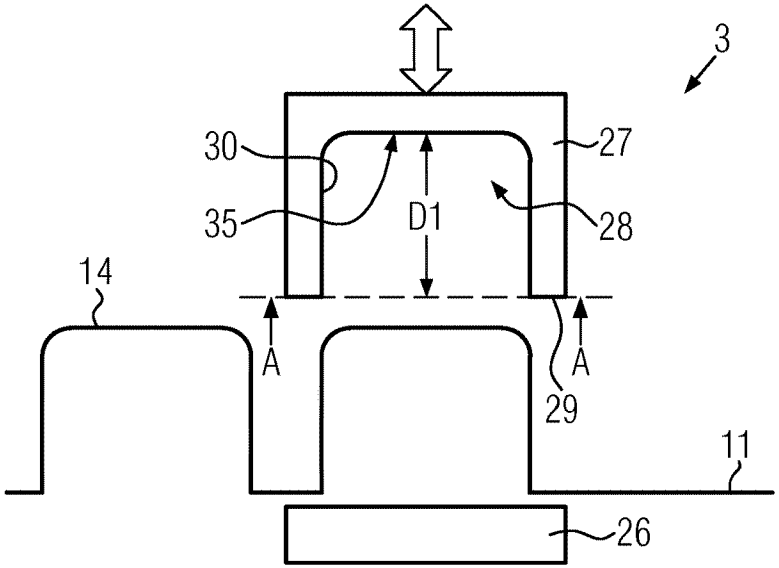
FIG. 3A is a schematic side view of a top-film forming station according to one embodiment of the present invention.

In the sealing station 4, the lids 14 may be forming, after the formation of a chamber 15 through a sealing-tool upper part 16 and a sealing-tool lower part 17, by means of a vacuum generated between the lids 14 and the domes 18, which are shown in more detail in FIG. 3A, onto the inner wall of the domes 18 in the sealing-tool upper part 16, and heated to a skin temperature of approximately 180° C., for example, so that they will have an adequate elasticity for the subsequent skinning process. At the same time, a further vacuum is applied in the interior of the package 19, viz. between the lids 14 and the troughs 9. Through this vacuum and by venting the sealing-tool upper part 16 to ambient pressure, the elastic lid 14 will fit snugly to the product 50 as well as to the trough 9, the skin film 11, i.e., the lids 14, and the trough 9 establishing a large-area, air-tight sealing during this skinning process. This package 19 can be referred to as skin pack, since the product 50 placed on or rather in the trough 9 is sealed in an air-tight manner onto the bottom film 7 or trough 9 by means of a film 11 which wraps tightly around the product 50, similar to a second skin.

While moving on in the production direction R, the packages 19 conveyed side by side on two lanes may be separated from one another by means of the cross cutting station 5 and the longitudinal cutting station 6 and conveyed out of the thermoform packaging machine 1 via a conveyor belt 20.

Figure 2A:
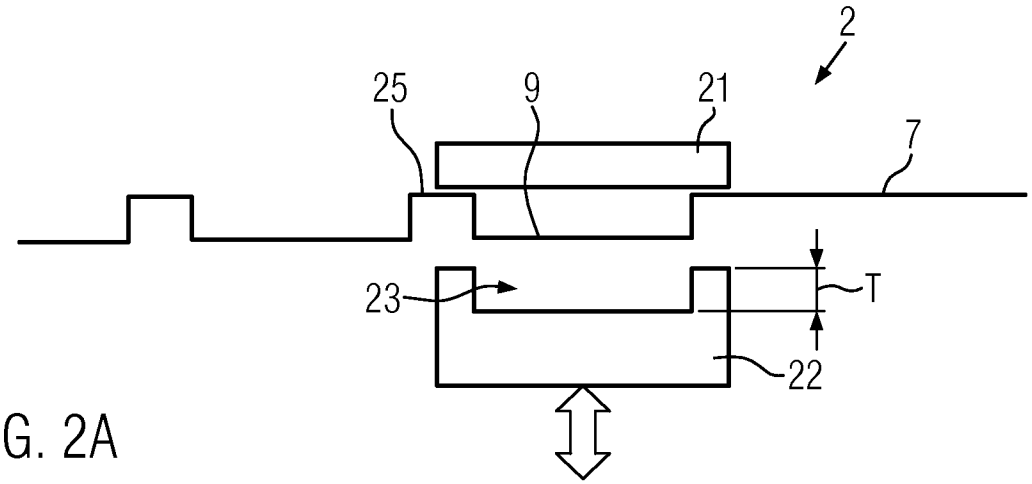
FIG. 2A is a schematic view of a bottom-film forming station according to one embodiment of the present invention.

In FIG. 2A, the bottom-film forming station 2 is shown in more detail. It can comprise a forming-tool upper part 21 located above the bottom film 7 and may be configured as a heating plate for heating the bottom film 7, prior to the forming step, to a temperature that is required for such forming. A forming-tool lower part 22 movable in the direction of the arrow and arranged below the bottom film 7 comprises two mold cavities 23 in which the heated bottom film 7 can be formed into troughs 9 by means of a vacuum from below and/or pressurized air from above. The trough 9 and the mold cavity 23 have a trough/cavity depth T oriented perpendicular to the bottom film 7. In addition, the trough 9 itself has, after the forming process, a trough edge 25.

Figure 2B:
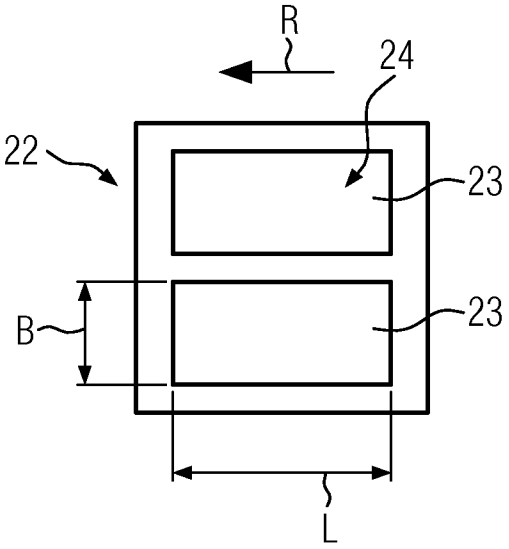
FIG. 2B is a top view of a forming-tool lower part according to one embodiment of the present invention.

FIG. 2B shows the forming-tool lower part 22 with the two mold cavities 23 in a top view. The two mold cavities 23 may each have an upwardly directed opening 24, each of the openings 24 having, in turn, an opening length L extending parallel to the conveying direction R and an opening width B extending transversely thereto.

Referring to FIG. 3A, the top-film forming station 3 will be explained in more detail. The top-film forming station 3 can comprise a top-film forming tool lower part 26 configured as a heating plate and a top-film forming tool upper part 27 movable in the direction of the arrow and comprising two domes 28 and a clamping surface 29 for clamping the skin film 11 between the top-film forming tool lower part 26 and the top-film forming tool upper part 27. The domes 28 have a first height D1 defined by the maximum depth of a hollow 35 relative to the plane of the clamping surface 29 and an inner wall 30. When the top-film forming station 3 is at a closed operating position, the skin film 11 can be clamped between the top-film forming tool lower part 26 and the top-film forming tool upper part 27, heated by the top-film forming tool lower part 26 and drawn into the domes 28 by means of a vacuum. After opening of the top-film forming station 3, a lid 14 has been formed in the skin film 11.

Figure 3B:
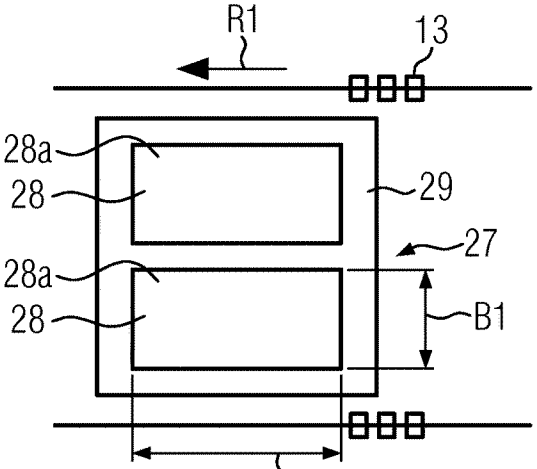
FIG. 3B is a top view of a top-film forming tool upper part according to one embodiment of the present invention.

FIG. 3B shows, from below, a sectional view of the clamping surface 29 of the top-film forming tool upper part 27. The two domes 28 can each be provided with an opening 28*a* having, in turn, an opening length L1 extending parallel to the conveying direction R1 of the skin film and an opening width B1 extending transversely thereto. These dimensions correspond to a very large extent to the complementary dimensions of the lids 14, since shrinking effects may occur. The skin film 11 is conveyed via a top-film conveying unit 13 shown in FIG. 3A in the form of clamp chains 13 arranged on both sides.

Figure 4A:
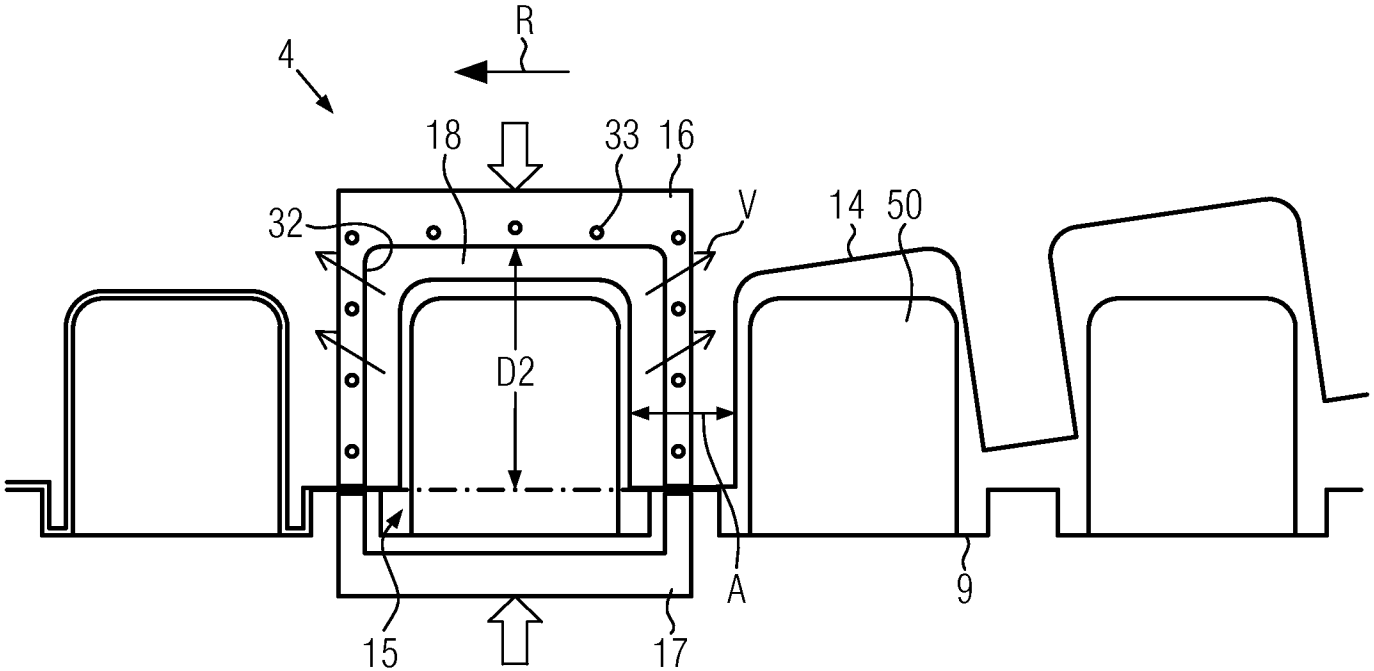
FIG. 4A is a schematic side view of a sealing station at a closed position according to one embodiment of the present invention.
Figure 4B:
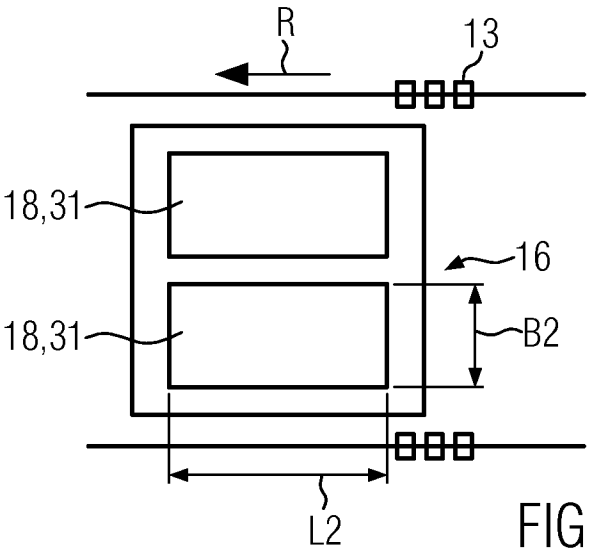
FIG. 4B is a view from below a sealing-tool upper part according to one embodiment of the present invention.

FIGS. 4A and 4B show the sealing station 4 in a condition in which the sealing-tool upper part 16 and the sealing-tool lower part 17 are closed, the products 50 being enclosed by the lids 14 and the troughs 9 and the lids 14 as well as the troughs 9 being circumferentially clamped in position between the sealing-tool upper part 16 and the sealing-tool lower part 17. In the defined chamber 15 the lids 14 may be sucked onto the inner wall 32 of the dome 18 of the sealing-tool upper part 16 through a vacuum V applied to the sealing-tool upper part 16, and fit then to the inner wall 32. The sealing-tool upper part 16 can comprise a heating 33 by means of which the lids 14 are heated to the skin temperature.

Analogously to FIG. 3B, the sealing-tool upper part 16 may comprise, like the top-film forming tool upper part 27, two domes 18 having an opening length L2 extending parallel to the production direction R and an opening width B2 extending transversely thereto as well as a second height D2. This can be seen in FIG. 4B, in which the domes 18 are shown from below. Reference numeral 31 stands here for the opening 18 of each dome 18. Each of the three dimensions L2, B2 and D2 of the domes 18 of the sealing-tool upper part 16 exceeds the dimensions L1, B1 and D1 of the domes 28 of the top-film forming tool upper part 27 by approximately 5% to 20% in size. One of the reasons for this is that it can be advantageous to provide a distance A between two lids 14 following one another in the conveying direction R, so that the sealing-tool upper part 16 can be moved to its closed position, as shown in FIG. 4A, without a lid 14 located directly upstream of the sealing station 4 being excessively negatively influenced by radiation heat of the sealing-tool upper part 16, even though, at this position, the lid 14 has already been pulled over the product 50 to a very large extent.

Figure 5:
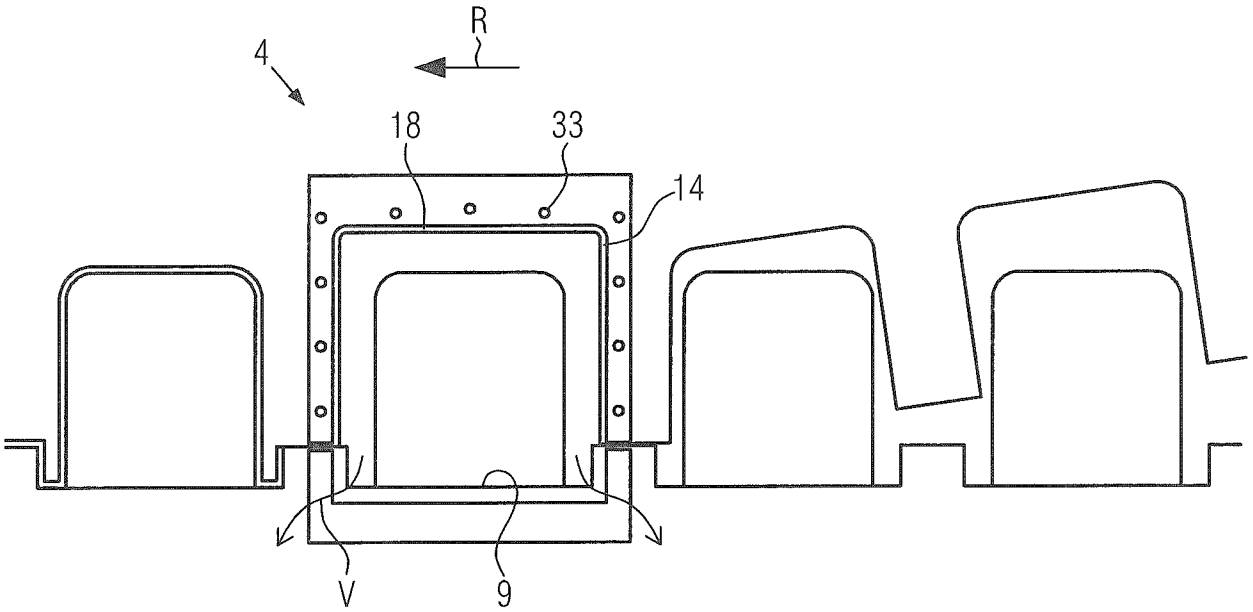
FIG. 5 is a schematic side view of the sealing station according to FIG. 4A after application of the skin film in the dome.

FIG. 5 shows the phase in which the lids 14 contact the domes 18 from inside and are heated by means of the heating 33 to a second temperature, i.e., the so-called skin temperature, whereas the space between the troughs 9 and the lids 14 is evacuated by means of a vacuum V.

Figure 6:
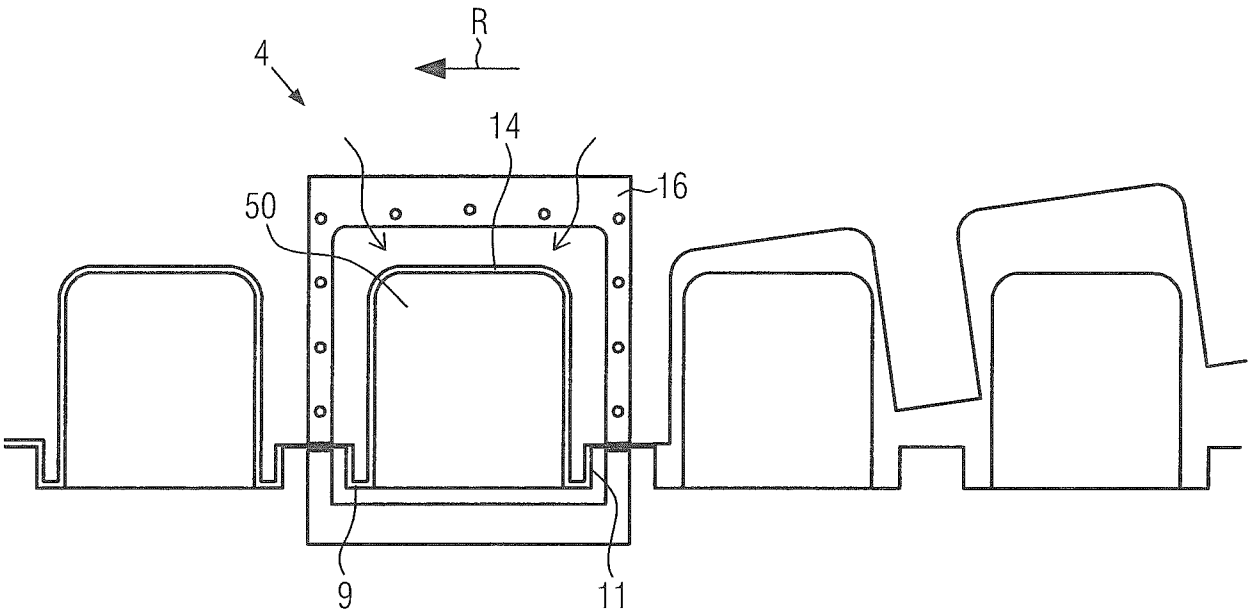
FIG. 6 is a schematic side view of the sealing station according to FIG. 4A after application of the skin film to the product and the trough.

FIG. 6 shows the situation after venting of the sealing-tool upper part 16 and after the lids 14, i.e., the skin film 11, have/has been applied to the product 50 and to the trough 9.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a bottom-film forming station including a number n of mold cavities for forming n troughs into a bottom film;

a top-film forming station including n evacuable first domes for forming n lids into a top skin film, wherein each first dome is enclosed by a clamping surface and has a first height, the first height defined by the maximum depth of a hollow in said first domes relative to the plane of the clamping surface, wherein the top-film forming station includes a first heating element to heat the top skin film to a temperature between 100° C. and 140° C.; and a sealing station configured for sealing the n lids with the n troughs associated therewith, wherein the sealing station includes a sealing-tool upper part comprising n heatable and evacuable second domes having a second height, wherein the sealing station includes a second heating element to heat the top skin film to a temperature between 170° C. and 220° C.;

wherein the second domes are configured for allowing the top skin film to be brought into contact with the respective second dome from inside;

wherein the first height is at least 80% of the second height;

wherein n is larger than or equal to two.

2. The thermoform packaging machine according to claim 1, wherein the second height is at least 60 mm.

3. The thermoform packaging machine according to claim 1 further comprising a top-film conveyor having conveying members disposed on both sides of the top skin film to advance the lids from the top-film forming station into the sealing station.

4. The thermoform packaging machine according to claim 1, wherein the mold cavities have a cavity depth, and wherein the second height of the second domes in the sealing-tool upper part is at least five times as large as the cavity depth.

5. The thermoform packaging machine according to claim 1, wherein the n mold cavities in the bottom-film forming station each have an opening length in a direction parallel to a production direction of the bottom film and an opening width in a direction transverse to the production direction of the bottom film;

wherein the n first domes in the top-film forming tool upper part each have a first opening length in a direction parallel to a production direction of the top film and a first opening width in a direction transverse to the production direction of the top film; and wherein the first opening length and the first opening width of the first domes amounting each to a value between 80% and 95% of the opening length and opening width, respectively, of the mold cavity, so that the molded lids will have dimensions that are larger than those of a product to be packed, when they are supplied to the sealing station.

6. The thermoform packaging machine according to claim 1, wherein said top skin film does not appreciably shrink upon application of heat.

* * * * *